US006107739A

United States Patent [19]

Ha

[11] Patent Number: 6,107,739

[45] Date of Patent: Aug. 22, 2000

[54] COLOR PDP FILLED WITH MIXTURE OF 3 GASES

[75] Inventor: Jang Soo Ha, Taegu-kwangyoksi, Rep. of Korea

[73] Assignee: LG Electronics Inc., Seoul, Rep. of Korea

[21] Appl. No.: 09/104,234

[22] Filed: Jun. 25, 1998

[30] Foreign Application Priority Data

Jun. 27, 1997 [KR] Rep. of Korea ..... 97/28175

[51] Int. Cl.[7] ..... H01J 61/16

[52] U.S. Cl. ..... 313/582; 313/643

[58] Field of Search ..... 313/581, 582, 313/643; 345/41, 60

[56] References Cited

U.S. PATENT DOCUMENTS 4,085,350 4/1978 Kagami et al. .

4,638,218 1/1987 Shinoda et al. .

5,525,862 6/1996 Miyazaki ..... 313/582

5,877,589 3/1999 Morgan et al. ..... 313/582 X 5,914,562 9/1999 Khan et al. ..... 313/582

5,959,403 9/1999 Lee ..... 313/582 X

*Primary Examiner*—Ashok Patel

*Attorney, Agent, or Firm*—Fleshner & Kim, LLP

[57] ABSTRACT

Color plasma display panel filled with a mixture of three gases, is disclosed, the PDP having a space for filling a discharge gas formed by sealing around first and second substrates fitted parallel to each other, electrodes for use in discharge of the discharge gas on an inside surface of at least one of the substrates, and fluorescent layers for being excited by ultraviolet rays from the gas discharge, wherein the discharge gas is a mixture of three gases of xenon, helium and neon, with concentrations of the xenon and helium being the same, whereby obtaining a long lifetime, a stable operation voltage and an appropriate luminance.

5 Claims, 5 Drawing Sheets

FIG. 4

%Xe

| %He | 0 | 5 | 10 | 15 | 20 | 25 | 30 |
|---|---|---|---|---|---|---|---|
| 0 | 0.150 | 0.376 | 0.557 | 0.701 | | 0.733 | |
| 5 | | | 0.649 | | | | |
| 10 | | 0.343 | 0.676 | 0.605 | 0.545 | 0.705 | |
| 15 | | | | | | | |
| 20 | | 0.448 | 0.649 | 0.716 | 0.727 | 0.716 | |
| 25 | | | | | | | |
| 30 | | | | | | | |
| 35 | | | | | | | |
| 40 | | | 0.126 | | | | |
| 45 | | | | | | | |
| 50 | | | | | | | |
| 55 | | | | | | | |
| 60 | | | | | | | |
| 65 | | | | | | | |
| 70 | | | | | | | |
| 75 | | | | | | | |
| 80 | | | 0.568 | | | | |
| 85 | | | | | | | |
| 90 | | | | | | | |
| 95 | | | | | | | |
| 100 | | | | | | | |
| operational voltage V | 100 | 111.7 | 123.3 | 135 | 146.7 | 158.3 | 170 |
| operating factor 1/V | 1 | 0.896 | 0.811 | 0.741 | 0.682 | 0.632 | 0.588 |

COLOR PDP FILLED WITH MIXTURE OF 3 GASES

BACKGROUND OF THE INVENTION

1. Field of the Invention

The present invention relates to an improvement of a discharge gas in a PDP(Plasma Display Panel), and more particularly, to a PDP filled with a mixture of three gases suitable for improvement of a composition of discharge gas which excites a fluorescent layer for displaying a color.

2. Discussion of the Related Art

Various forms of PDP's, driven in general by DC or AC and using an ultraviolet ray generated by a gas discharge, have been widely used, not only for display of characters, but also for display of images. It is known that the color display can be achieved by forming layers of different fluorescent materials in a discharge panel and exciting the layers with an ultraviolet ray generated by related gas discharge.

Typical type of PDP's using a surface discharge, such as the PDP shown in FIGS. 1 and 2 and the one as disclosed in U.S. Pat. No. 4,638,218 use various fluorescent materials for implementation of a color PDP. Basically, of one pair of substrates forming a sealed panel in such a color PDP, discharge electrodes 3, 4, 6 and 7 are provided only on a first substrate 1, while a top substrate 2 opposite to the first substrate 1 is provided with fluorescent layers 8, which will be excited by an ultraviolet ray generated by gaseous discharge, on an inside surface thereof, to emit a color light fixed by different fluorescent layers 8. The gas discharge electrodes are arranged on the top substrate 1 in X-, and Y-directions perpendicular to, and separated from each other. Surfaces of the electrodes 3, 4, 6 and 7 are coated with a protection layer 10 having a high secondary electron emission, such as MgO. This configuration prevents the fluorescent layers 8 from being degraded by direct impacts of ions generated in the discharge gas. Accordingly, such a configuration has been used until now for prolonged lifetime of the fluorescent layers.

As disclosed in U.S. Pat. No. 4,085,350, the discharge gases have been studied widely, which emits an ultraviolet ray for exciting the fluorescent layers to emit a visible light. It is known that a mixture gas of two gases(He+Xe), such as helium and xenon has been mostly used as a gas for displaying multiple colors in which color purities of lights have an important role. Xenon gas, known well as the penning effect, is used for lowering, not only a discharge sustaining voltage, but also a discharage initiating voltage. Heavy xenon ions in this gas give impact on a surface of magnesium oxide MgO coated on the electrodes. The magnesium oxide MgO layer is rapidly degraded by the ion impact, that shorten a lifetime of the PDP.

In a background art 3 component gas, the xenon gas is mixed in a fixed ratio of 0.2 vol %, at a gas pressure of 600 Torr. The fluroescent layer 8 used in this case is PIGI ($Zn_2SiO_4$:Mn) which is used widely and can be coated on all surface evenly. It is observed that a presence of argon gas over 5 vol % eliminates an orange color component from a neon gas discharge. The operation voltage rises when the argon gas present more than 80 vol %, with an increased driving circuit cost and an improved luminance effect. Therefore, a mixture gas He+Ar+Xr of three gases is used, in which argon gas, heavier than helium, is mixed with xenon gas for effective dropping of the xenon ion energy which give impact onto the surface of the magnesium oxide. However, the mixture gas He+Ar+Xr of three gases has a problem in that the mixture gas raises the operation voltage. A mixture of two gases(He+Xe) has been used for exciting one of R, G, B fluorescent materials and displaying a color.

However, a neon gas dischrage degrades a color purity. In practical use, all the requrements of a long lifetime, a low operation voltage, a satisfactory luminance and a color purity for a PDP are important conditions. However, any of the background art have satisfied those conditions on the same time.

SUMMARY OF THE INVENTION

Accordingly, the present invention is directed to a color PDP filled with a mixture of three gases that substantially obviates one or more of the problems due to limitations and disadvantages of the related art.

An object of the present invention is to provide a color PDP filled with a mixture of three gases which improves a lifetime, a low voltage opertion, an appropriate luminance and a suitable color purity.

Another object of the present invention is to provide a color PDP filled with a mixture of three gases which increases an intensity of a ultraviolet ray.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the discharge gas in cells of PDP in which the discharge gas composed of xenon, helium and neon emits an ultraviolet ray, excites fluorescent layers to emit lights, has a composition of which xenon and helium ratios are the same, with the rest of neon.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 4 is a table showing optimal operating factors with respect to conentration vol % for helium gas and xenon gas applied to the present invention;

DETAILED DESCRIPTION OF THE PREFERRED EMBODIMENT

Figure 1:
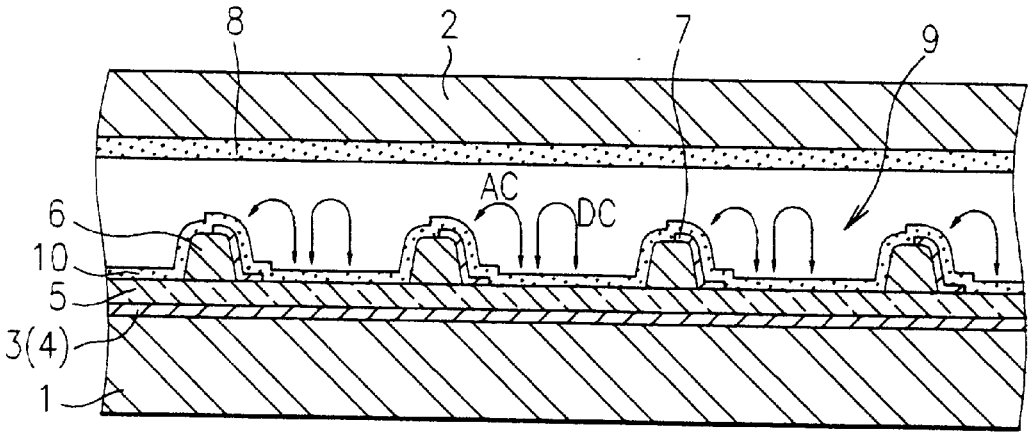
FIG. 1 background art
FIG. 1 illustrates a cross section of a background art PDP of a surface discharge type.
Figure 2:
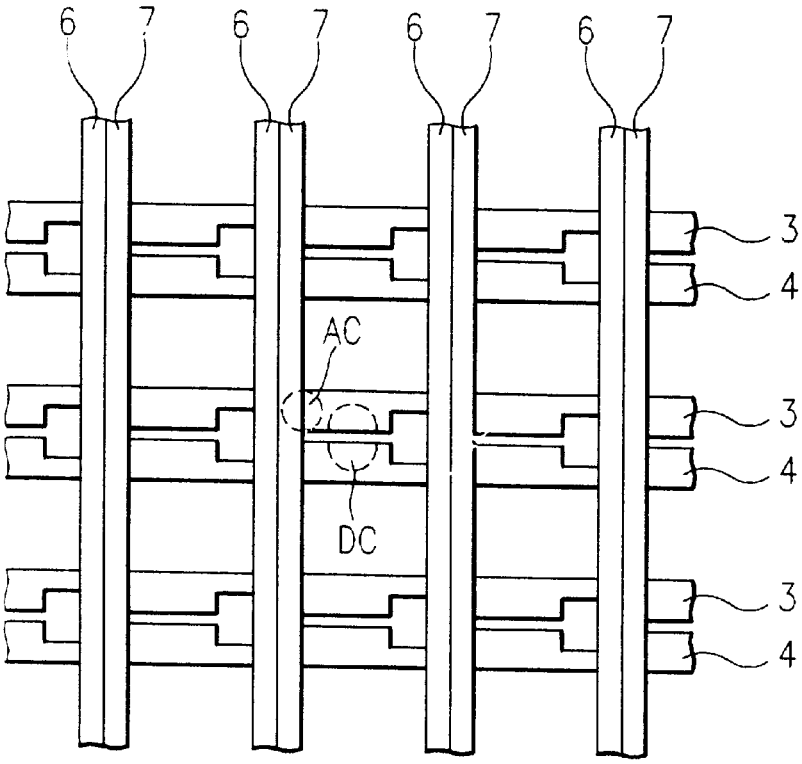
FIG. 2 background art
FIG. 2 illustrates a plan view showing a layout of the address electrodes and the common electrodes in FIG. 2.
Figure 3:
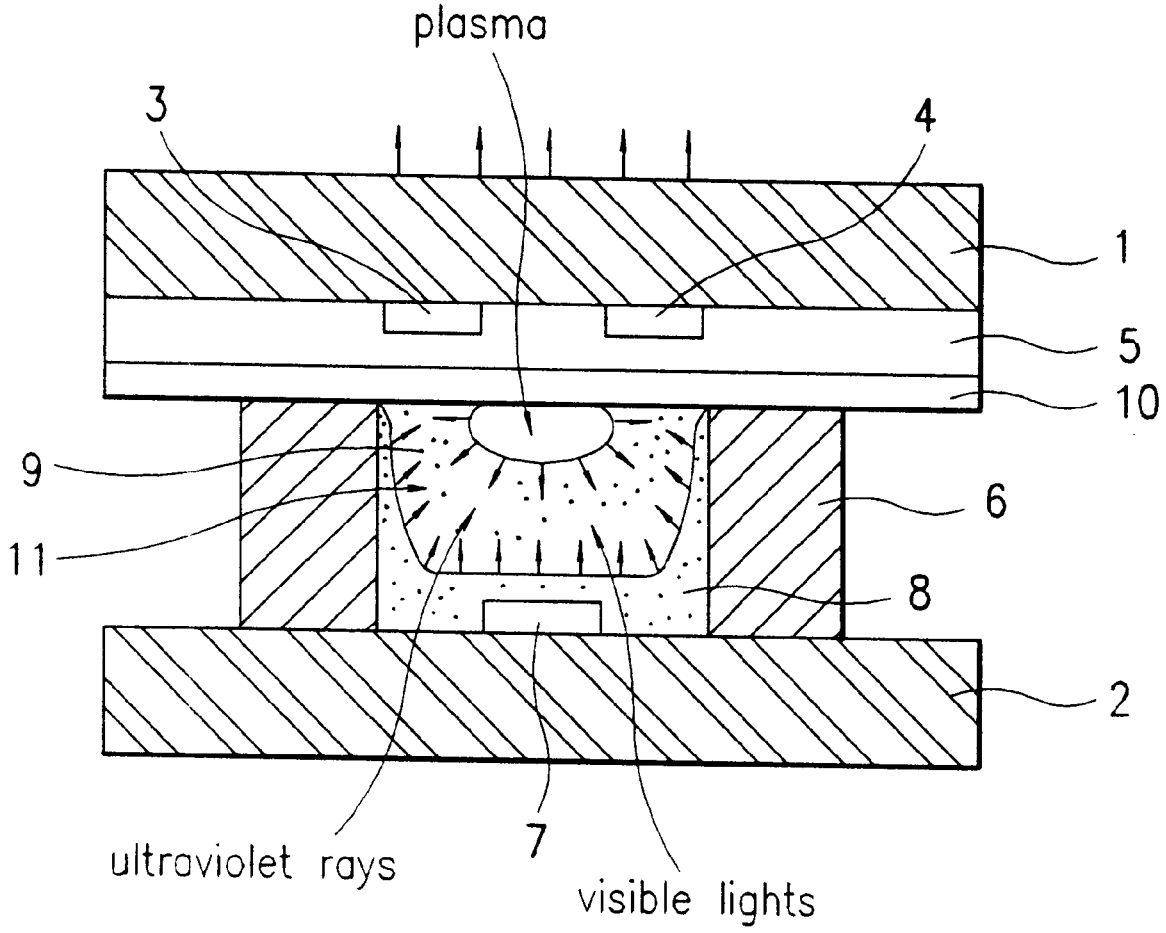
FIG. 3 illustrates a cell of a color PDP filled with a mixture of 3 gases in accordance with a preferred embodiment of the present invention.

Reference will now be made in detail to the preferred embodiments of the present invention, examples of which are illustrated in the accompanying drawings. FIG. 3 illustrates a cell of a color PDP filled with a mixture of 3 gases in accordance with a preferred embodiment of the present invention, wherein components with the same reference numerals denote the same components.

Referring to FIG. 3, in the AC PDP of the present invention, insulating ribs 6 hold a first substrate 1 and a second substrate 2 to be in parallel and isolate cells, and two sustain electrodes 3 and 4 are arranged in parallel on the first substrate 1. The sustain electrodes 3 and 4 are disposed in a form of a matrix opposite to address electrodes 7 on the second substrate 2. A dielectric layer 5 covers and protects the sustain electrodes. And, as the electrodes are covered with the dielectric layer, a discharge generated by a DC voltage applied between the electrodes is extinguished soon. In a case of a PDP with such an electrode system, an alternative current, alternating polarities, should be applied to the electrodes for having a sustained discharge. And, there is a protection layer 10 covering the dielectric layer 5. The protection layer 10 mostly of magnesium oxide MgO thin film, not only protects the dielectric layer 5 and prolongs a lifetime, but also increases an efficiency of secondary electron discharge and reduces a degradation of a discharge characteristic due to oxide contamination of refractory metal. The fluorescent layers 8, coated on the second substrate 2 inclusive of the insulating ribs 6, are excited by the ultraviolet rays generated from the discharge to emit red(R), green(G) and blue(B) visible lights. There is a discharge space 11, a cell space for discharge, filled with a mixture of 3 gases of xenon Xe, helium He and neon Ne for enhancing ultraviolet ray emission. In the aforementioned PDP, the first and second substrates 1 and 2 are assembled held a distance apart facing each other, sealed tightly, and, then, the three discharge gases are filled in the discharge space 11. According to the aforementioned structure, upon application of a voltage between the common electrodes 3 and 4 higher than an operation initiating voltage of the PDP, all cells on a line start gaseous discharges, and unnecessary gaseous discharges in cells corresponding to unnecessary pixels on the line can be canceled by canceling related address discharges.

When a composition of the dischrage gas filled in the cell of the PDP is modified, a panel performance is improved. An effect of addition of different amount of neon gas to a mixture of xenon and helium Xe+He of the same composition is shown in FIG. 4. FIG. 4 illustrates a table of optimal operating factors according to an operational voltage for vol % xenon Xe gas and vol % helium gas He. As can be known from the table, when xenon Xe gas and helium He gas are mixed in the same composition ratios, i.e., in the same percentages at a pressure of 400~550 Torr, an optimal operating factor can be obtained. In this instance, the xenon gas and the helium gas are mixed at fixed ratios of 5 vol %, 10 vol %, 15 vol %,—both at a pressure of 500 Torr. It is observed from this table that presence of 10 vol % 20 vol % both of xenon gas and helium gas eliminates orange visible lights from neon gas discharge, that improves a luminance. Though a composition ratio of over 80 vol % of neon in the mixture of two gases raises an operating voltage with an improvement of luminance, such a composition ratio is not practicable.

Figure 5:
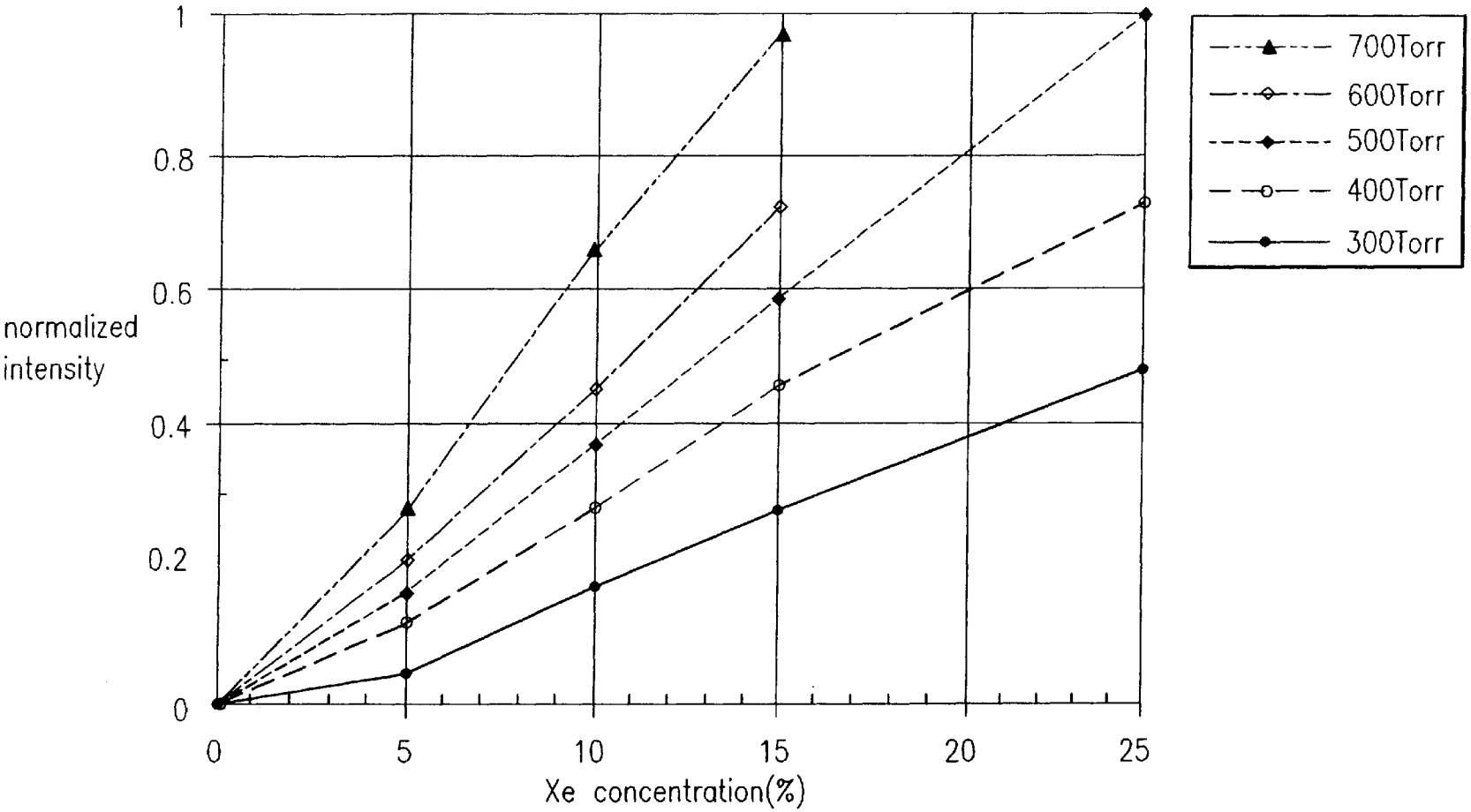
FIG. 5 illustrates characteristic curves of a normalized intensity versus a concentration of xenon gas of FIG. 4; and, FIG. 6 illustrates characteristic curves showing an intensity of a ultraviolet ray for the mixture of 3 gases in accordance with a preferred embodiment of the present invention.
Figure 6:
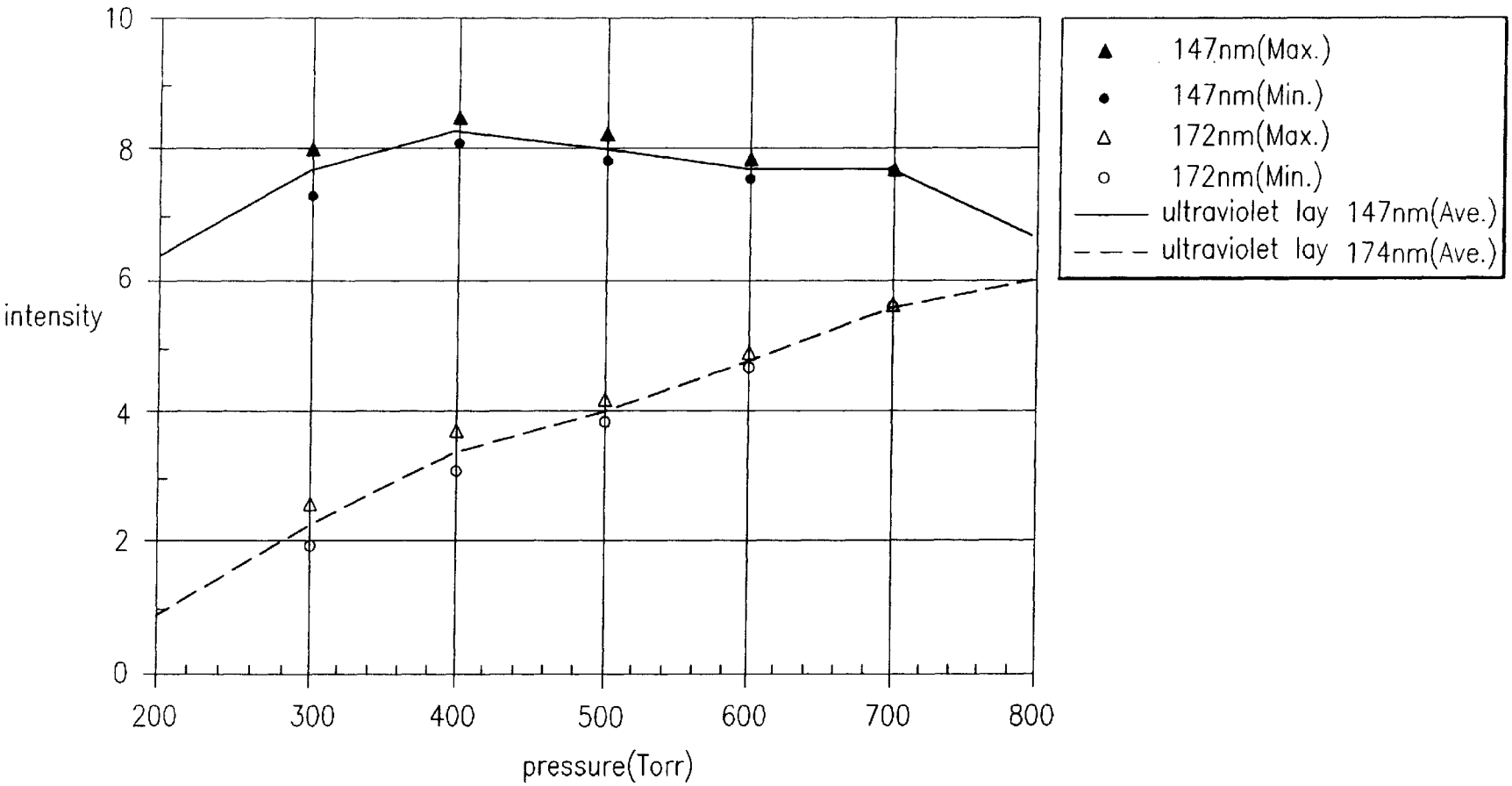

FIG. 5 illustrates characteristic curves of a normalized intensity versus a concentration of xenon gas of FIG. 4, wherefrom it is observed that a maximum luminance is obtained when a composition ratio of xenon is 15 vol % at a pressure of 500 Torr. FIG. 6 illustrates characteristic curves showing an intensity of a ultraviolet ray for the mixture of 3 gases in accordance with a preferred embodiment of the present invention.

In this instance, a composition of the discharge gas is Xe(10 vol %)+He(10 vol %)+Ne(80 vol %) at a pressure of 500 Torr. And, emission of the ultraviolet rays, serving for an increased luminance, increases as the gas pressure increases at 172 nm, and emission of 147 nm ultraviolet ray reaches to the maximun at 400 Torr and decreases little by little as the gas pressure increases. As both of these two wavelengths serve for luminance, it is observed that 500 Torr is the most appropriate pressure in view of luminance. The above composition ratio satisfies Xe(5~25 vol %)+helium(5~25 vol %)+neon(90~50 vol %). Of the mixture of three gases, the xenon gas, not only serves for the penning effects, an original purpose, in which a dischrage voltage and a sustain voltage is lowered in the gaseous discharge, but also emits a spectrum of lights of its own to excite the fluorescent layers during the discharge. And, ions of the xenon gas give a substantial effect to memory effect, such as wall charges in an AC operative gas discharge panel. Accordingly, as can be observed in FIG. 4, a concentration of below 20 vol % of xenon is effective for lowering the operation voltage, appropriately. However, as the xenon gas has a danger of explosion, an operation voltage in a range of 8 vol % at the minimum is the most appropriate, if a low operation voltage is pursued to an extreme, but not over 25 vol % at the maximum. Accordingly, if the xenon gas, use of which has been avoided until now due to its danger of explosion, may be mixed to use a mixture of 3 gases inclusive of helium and neon, a color plasma display panel can be achieved, which has a long lifetime, a stable operation voltage and an appropriate luminance.

Though the AC driven PDP of a surface discharge type is explained as an example of the present invention, the present invention is applicable to other field widely, such as a gas dischrage panel in which a light from a gaseous discharge is used for exciting fluorescent layers and displaying a desired color. It will be apparent to those skilled in the art that various modifications and variations can be made in the color PDP filled with a mixture of 3 gases of the present invention without departing from the spirit or scope of the invention. Thus, it is intended that the present invention cover the modifications and variations of this invention provided they come within the scope of the appended claims and their equivalents.

What is claimed is:

1. A color plasma display panel(PDP) filled with a mixture of three gases, the PDP having a space for filling a discharge gas formed by sealing around first and second substrates fitted parallel to each other, electrodes for use in discharge of the discharge gas on an inside surface of at least one of the substrates, and fluorescent layers for being excited by ultraviolet rays from the gas discharge, wherein the discharge gas is a mixture of three gases of xenon, helium and neon, with concentrations of the xenon and helium being the same.

2. A color plasma display panel as claimed in claim 1, wherein the concentration of the xenon in the discharge gas is below 5~25 vol %.

3. A color plasma display panel as claimed in claim 2, wherein the concentration of the xenon in the discharge gas is below 5~10 vol %.

4. A color plasma display panel as claimed in claim 1, wherein the discharge gas is a mixture of xenon+helium+neon at 400~550 Torr.

5. A color plasma display panel as claimed in claim 4, wherein the mixture has composition ratios of xenon(5~10 vol %)+helium(5~10 vol %)+neon(90~80 vol %).

* * * * *